United States Patent [19]

Kurosawa et al.

[11] Patent Number: 4,732,544

[45] Date of Patent: Mar. 22, 1988

[54] VARIABLE CAPACITY WOBBLE PLATE COMPRESSOR

[75] Inventors: Juetsu Kurosawa; Takeo Iijima; Hiroshi Nomura, all of Konan; Takashi Koike, Tokyo, all of Japan

[73] Assignees: Diesel Kiki Co., Ltd.; Fujikoki Manufacturing Co., Ltd., both of Tokyo, Japan

[21] Appl. No.: 58,288

[22] Filed: Jun. 4, 1987

[30] Foreign Application Priority Data

Jun. 12, 1986 [JP] Japan ..... 61-137351
Jun. 12, 1986 [JP] Japan ..... 61-137352

[51] Int. Cl.[4] ..... F04B 1/26
[52] U.S. Cl. ..... 417/222; 417/270
[58] Field of Search ..... 417/222, 270

[56] References Cited

U.S. PATENT DOCUMENTS

| | | | |
|---|---|---|---|
| 4,037,993 | 7/1977 | Roberts | 417/222 |
| 4,073,603 | 2/1978 | Abendschein et al. | 417/222 |
| 4,145,163 | 3/1979 | Folgelberg et al. | 417/222 |
| 4,174,191 | 11/1979 | Roberts | 417/222 |
| 4,231,713 | 11/1980 | Widdowson et al. | 417/222 |
| 4,236,875 | 12/1980 | Widdowson | 417/222 |
| 4,428,718 | 1/1984 | Skinner | 417/222 |
| 4,480,964 | 11/1984 | Skinner | 417/222 |
| 4,526,516 | 7/1985 | Swain et al. | 417/222 |
| 4,586,874 | 5/1986 | Hiraga et al. | 417/222 |
| 4,606,705 | 8/1986 | Parekh | 417/222 |
| 4,664,604 | 5/1987 | Terauchi | 417/222 |
| 4,687,419 | 8/1987 | Suzuki et al. | 417/222 |
| 4,688,997 | 8/1987 | Suzuki et al. | 417/222 |

FOREIGN PATENT DOCUMENTS 58-158382 9/1983 Japan ..... 417/222

*Primary Examiner*—Carlton R. Croyle
*Assistant Examiner*—Paul F. Neils
*Attorney, Agent, or Firm*—Frishauf, Holtz, Goodman & Woodward

[57] ABSTRACT

A variable capacity wobble plate compressor in which pressure in a crankcase accomodating a wobble plate is controlled by a pressure-control valve disposed across a communication passage connecting the crankcase and a suction chamber, whereby the delivery quantity or capacity is varied with a change in the inclination angle of the wobble plate depending on the pressure in the crankcase. The pressure-control valve comprises bellows variable in length with a change in the magnituted of suction pressure, a valve body attached to one end of the bellows, a first movable member attached to the other end of the bellows, a first spring urging the valve body in the closing direction, a second movable member which is brought into or out of urging contact with the first movable member in response to at least a change in the discharge pressure, and a second spring interposed between the second movable member and a spring seat. When the discharge pressure is higher than a predetermined value, the second movable member is biased away from the first movable member by the discharge pressure against at least the force of the second spring. When the discharge pressure is lower than the predetermined value, the second movable member is urged against the first movable member by at least the force of the second spring against the discharge pressure to urge the valve body in the closing direction via the first movable member, the first spring and the bellows.

3 Claims, 4 Drawing Figures

VARIABLE CAPACITY WOBBLE PLATE COMPRESSOR

BACKGROUND OF THE INVENTION

This invention relates to a variable capacity wobble plate compressor for compressing refrigerant used in air conditioners for vehicles, etc.

A variable capacity wobble plate compressor is known which has such a construction that pressure in a crankcase in which a wobble plate is accomodated is regulated to adjust the inclination angle of the wobble plate, whereby the delivery quantity or capacity varies. This kind of conventional variable capacity wobble plate compressor is disclosed, for example, in Japanese Provisional Patent Publication (Kokai) No. 58-158382.

In this kind of compressor, the pressure in the crankcase where the wobble plate is provided is formed by pressure leaking through clearances between cylinders and pistons, i.e., blow-by gas pressure. Therefore, the pressure in the crankcase is higher than that in the suction chamber of the compressor during operation. When the compressor is heavily loaded due to a great thermal load on the air conditioner, i.e., suction pressure is higher than a predetermined value, a pressure-control valve provided across a communication passage between the crankcase and the suction chamber opens to allow the pressure in the crankcase (formed by blow-by gas) to flow into the suction chamber, whereby the pressure in the crankcase is lowered, accompanied by an increase in the inclination angle of the wobble plate. The increase in the inclination angle of the wobble plate causes a corresponding increase in the stroke of the piston, i.e., an increase in the delivery quantity or capacity. If the thermal load is decreased (medium load state), and accordingly the suction pressure is lowered, the degree of opening of the pressure-control valve becomes smaller in accordance with the lowering of the suction pressure. This reduces the amount of pressure flowing from the crankcase into the suction chamber, which results in an increase in the pressure in the crankcase, accompanied by a decrease in the inclination angle of the wobble plate. This, in turn, shortens the stroke of the piston, i.e., the capacity is decreased. In the above-described manner, the capacity of the compressor automatically varies with a change in the thermal load.

In the meanwhile, when the compressor is under a low load state, if refrigerant is allowed to constantly flow at a fixed rate through the evaporator in spite of a low thermal load, the suction pressure so decreases that the boiling temperature of the refrigerant lowers, which can result in freezing of the evaporator.

In order to prevent such freezing of the evaporator, conventionally, there is provided an antifreeze valve (hereinafter referred to as the A.F. valve). The A.F. valve comprises a piston valve of a check valve type provided across a communication passage which communicates between the discharge pressure chamber and the crankcase. The A.F. valve does not open and is maintained in a closed state when the discharge pressure is in a region higher than a predetermined value. When the discharge pressure is lowered from this region to a freezing region lower than the predetermined value, the A.F. valve opens and part of the pressure in the discharge pressure chamber is allowed to flow into the crankcase, which increases the pressure in the crankcase, accompanied by a decrease in the inclination angle of the wobble plate. This shortens the sroke of the piston, i.e., the capacity is reduced. The reduced capacity lessens the amount of refrigerant passing through the evaporator, which prevents the evaporator from being frozen.

However, if the amount of refrigerant passing through the evaporator is decreased as described above, assuming that the heat exchange rate is constant, the temperature on the low pressure side of the evaporator is raised. The refrigerant gains pressure if its temperature is increased. Thus, if in an attempt to decrease capacity, higher pressure is introduced into the crankcase to make the crankcase pressure higher, the suction pressure is also raised. Then, in response to the elevated suction pressure, bellows of the pressure-control valve provided for keeping the suction pressure constant operates to open the valve, which allows the pressure introduced via the A.F. valve into the crankcase from the discharge pressure chamber to leak into the suction chamber via the pressure-control valve. As a result, the pressure in the crankcase lowers to increase the inclination angle of the wobble plate. Thus, in spite of the A.F. valve being open, the inclination angle of the wobble plate is increased, and part of the compressed refrigerant which is introduced via the A.F. valve into the crankcase from the discharge pressure chamber returns to the suction chamber, which causes power loss.

SUMMARY OF THE INVENTION

It is the object of the present invention to provide a variable capacity wobble plate compressor which is free from power loss, while being provided with the function of the A.F. valve, which makes it possible to prevent the evaporator from being frozen, as well as with a pressure-control valve which keeps the suction pressure constant.

According to the present invention, there is provided a variable capacity wobble plate compressor which includes: a crankcase; a wobble plate accomodated within the crankcase; a suction chamber; a communication passage communicating between the crankcase and the suction chamber; and a pressure-control valve disposed across the communication passage for adjusting pressure in the crankcase to change the inclination angle of the wobble plate whereby the delivery quantity or capacity is varied.

The pressure-control valve comprises deformable means variable in length with a change in the suction pressure; a valve body attached to one end of the deformable means for selectively opening and closing the communication passage depending on the length of the deformable means; a first movable member attached to the other end of the deformable means; a first spring interposed between the valve body and the first movable member and urging the valve body in a closing direction; a second movable member having a pressure-receiving portion for receiving at least discharge pressure, said second movable member being selectively brought into and out of urging contact with the first movable member in response to at least a change in the discharge pressure acting upon the pressure-receiving portion; and a spring seat disposed in opposite and spaced relation to the pressure-receiving portion of the second movable member; and a second spring interposed between the spring seat and the second movable member. When the discharge pressure is higher than a predetermined value, the second movable member is biased away from the first movable member by the discharge pressure against the force of the second spring, and when the discharge pressure is lower than the predetermined value, the second movable member is urged against the first movable member by the force of the second spring against the discharge pressure to urge the valve body in the closing direction via the first movable member, the first spring, and the deformable means.

According to one embodiment of the present invention, the pressure-receiving portion of the second movable member receives at one side surface thereof the discharge pressure and at another side surface thereof the suction pressure. When the discharge pressure is higher than a predetermined value, the second movable member is biased away from the first movable member by the force of the discharge pressure against the sum of the force of the second spring and the suction pressure, and when the discharge pressure is lower than the predetermined value, the second movable member is urged against the first movable member by the sum of the force of the second spring and the suction pressure against the discharge pressure to urge the valve body in the closing direction via the first movable member, the first spring, and the deformable means.

According to another embodiment of the present invention, there is provided second deformable means variable in length with a change in the discharge pressure. The second movable member is attached to one end of the second deformable means, and the spring seat is attached to the other end of the second deformable means. When the discharge pressure is lower than a predetermined value, the second movable member is urged against the first movable member by the force of the second spring against the force of the discharge pressure to urge the valve body in the closing direction via the first movable member, the first spring, and the first-mentioned deformable means.

Thus, according to the variable capacity wobble plate compressor of the present invention, under such a condition that the discharge pressure lowers below such a predetermined value that the evaporator can be brought into a frozen state, the valve body is strongly urged in the closing direction by a substantially enhanced force due to the force of the second spring to thereby increase the force that urges the valve body in the closing direction, or the keeps same in the closing position, i.e. the valve opening pressure so that the pressure in the crankcase is accordingly elevated to decrease the inclination angle of the wobble plate. This causes a decrease in the delivery quantity or capacity, which, in turn decreases the amount of refrigerant passing through the evaporator, preventing the evaporator from being frozen.

The above and other objects, features, and advantages of the invention will be more apparent from a reading of the following detailed description taken in connection with the accompanying drawings.

BRIEF DESCRIPTIOIN OF THE DRAWINGS

DETAILED DESCRIPTION

The invention will now be described in detail with reference to the drawings showing preferred embodiments thereof.

Figure 1:
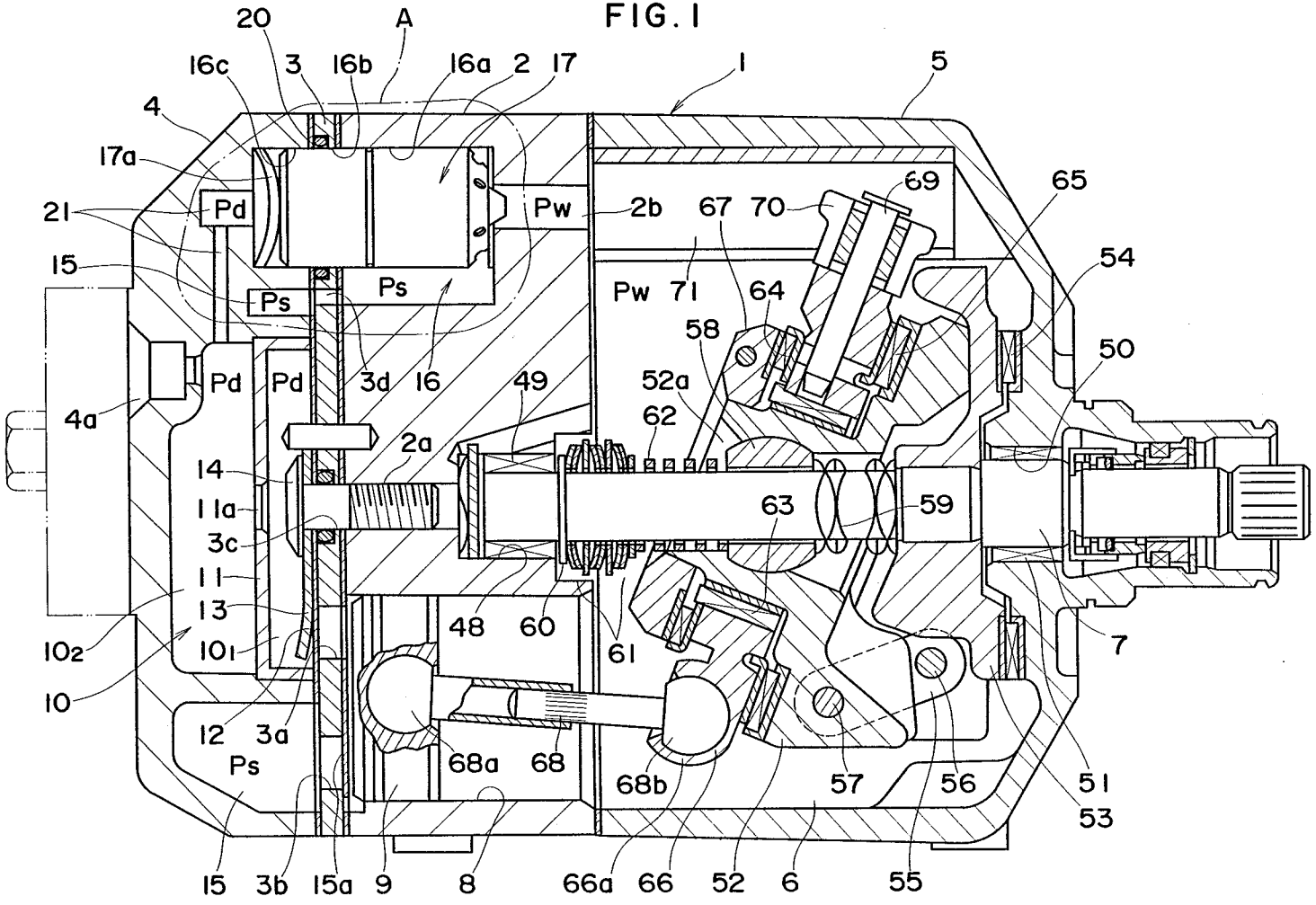
FIG. 1 is a longitudinal cross-sectional view of a variable capacity wobble plate compressor of the present invention.

Referring first to FIG. 1, there is illustrated a variable capacity wobble plate compressor according to the invention. In the figure, reference numeral 1 designates a housing of the compressor, which is formed of a cylinder block 2, a rear head 4 secured in airtight manner to a left end face of the cylinder block 2 as viewed in FIG. 1 through a valve plate 3, and a front head 5 secured in airtight manner to a right end face of the cylinder block 2. A crankcase 6 is defined within the interior of the housing 1 by an end face of the cylinder block 2 facing toward the front head 5, and inner peripheral walls and an inner end wall of the front head 5. A drive shaft 7 is arranged within the housing 1 and extends substantially along the axis of the housing. A plurality of cylinders 8 are formed in the cylinder block 2 in circumferentially equally spaced relation and extend with their respective axes parallel with the axis of the drive shaft 7, and in each of which is slidably fitted a piston 9.

Formed in a left end face of the rear head 4 is a discharge port **4*a* through which compressed refrigerant gas is discharged. Defined in a substantially central portion of the rear head 4 is a discharge pressure chamber 10 which is divided into a first discharge pressure chamber $\mathbf{10_1}$ and a second discharge pressure chamber $\mathbf{10_2}$ by a partition wall 11. The first and second discharge chambers $\mathbf{10_1}$ and $\mathbf{10_2}$ communicate with each other through a restriction hole 11*a* provided in the partition wall. Accordingly, outlet ports 3*a* which are provided in the valve plate 3 communicate with the discharge port 4*a* via the first discharge pressure chamber $\mathbf{10_1}$, the restriction hole 11*a* and the second discharge pressure chamber $\mathbf{10_2}$, in the mentioned order. The outlet ports 3*a* are opened and closed by means of respective discharge valves 12. The discharge valves 12 are mounted on the valve plate 3 at a side surface thereof facing toward the rear head 4 together with retainers 13 by means of a set screw 14 which is threadedly fitted in a tapped hole 2*a* in the cylinder block 2 in a airtight manner through a hole 3*c* formed through the valve plate 3. A suction chamber 15 is formed around the discharge pressure chamber 10 in the rear head 4, which communicates with the cylinders 8 through respective inlet ports 3*b* formed through the valve plate 3. The inlet ports 3*b* are opened and closed by means of respective suction valves 15*a*, which are mounted on the valve plate 3 at a side surface thereof facing toward the cylinder block 2**.

The suction chamber 15 communicates with the outlet of an evaporator, not shown, of the air conditioning system through a suction port, not shown, while the discharge pressure chamber 10 communicates with the inlet of a condenser, not shown, of the air conditioning system, through the discharge port **4*a***.

Figure 2:
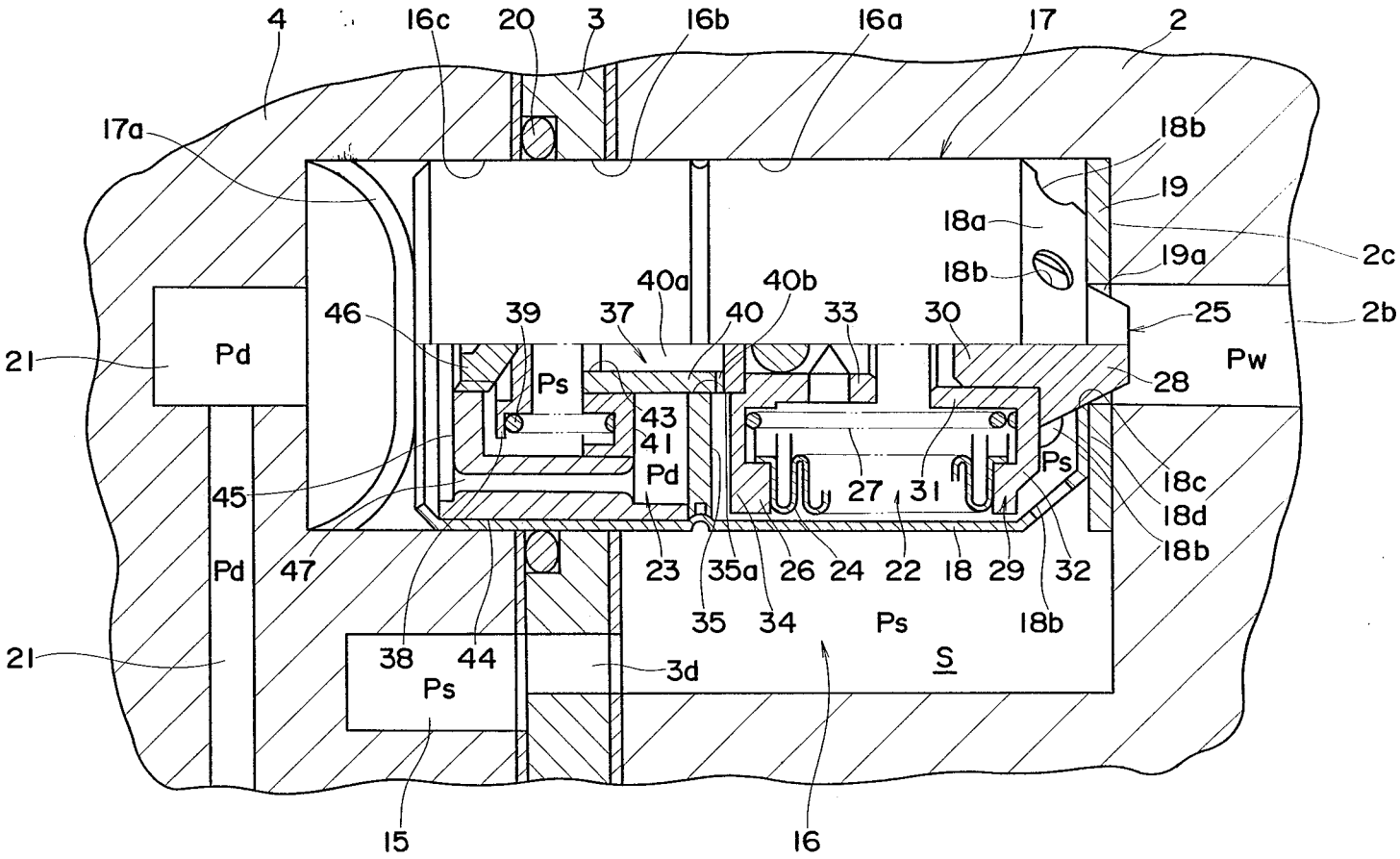
FIG. 2 is an enlarged fragmentary view of a portion A in FIG. 1 which illustrates a pressure-control valve of a first embodiment of the present invention.

A valve chamber 16 is formed in the cylinder block 2, the valve plate 3, and the rear head 4. The valve chamber 16 communicates with the crankcase 6 via a communication passage **2*b* formed in the cylinder block 2. The valve chamber 16 also communicates with the suction chamber 15 via a hole 3*d* formed through the valve plate 3. Received within the valve chamber 16 is a pressure-control valve 17, which forms an essential portion of the compressor according to the present invention. The pressure-control valve 17 controls the pressure in the crankcase 6, and has a cylindrical casing 18 as shown in FIG. 2 illustrating a first embodiment of the present invention. The casing 18 is received within the valve chamber 16. One end face of the casing 18 is disposed in contact with an end face of a portion 16***a* of the valve chamber 16 located in the cylinder block 2 via a seat member 19. The casing 18 is fitted through a portion 16*b* of the valve chamber 16 located in the valve plate 3 in airtight manner by means of an O ring 20, with the other end being positioned in a portion 16*c* of the valve chamber 16 located in the rear head 4.

A space S is defined between an outer peripheral surface of the casing 18, and inner surfaces of the portion 16*a* of the valve chamber 16, and an end face of the valve plate 3.

A peripheral surface 18*a* of one end of the casing 18 is tapered in a manner decreasing in diameter toward the one end face of the casing 18. A plurality of holes 18*b* are formed in the tapered surface 18*a* in circumferentially spaced relation. Formed through a central portion of the one end of the casing 18 is a valve hole 18*c* which is aligned and communicates with the communication passage 2*b* in the cylinder block 2 via a hole 19*a* formed through the seat member 19. Further, the other end of the casing 18, which is open, communicates with the second discharge pressure chamber $10_2$ of the discharge pressure chamber 10 via a communication passage 21 formed in the rear head 4. A low pressure-operated portion 22 of the pressure-control valve 17 is disposed within a half portion of the casing 18 toward the one end thereof and a high pressure-operated portion of the presure-control valve 17 within the other half portion of the casing 18, respectively.

The low pressure-operated portion 22 comprises bellows 24, a valve body 25 attached to one end (right end as viewed in FIG. 2) of the bellows 24, a first movable member 26 attached to the other end (left end as viewed in FIG. 2) of the bellows 24, a first spring 27 urging the valve body 25 in the closing direction. The bellows 24 is in the form of a hollow cylinder with opposite open ends and corrugated peripheral surfaces. The bellows is expandable and contractible in the longitudinal direction depending on the suction pressure Ps introduced through the hole 18*b* into the casing 18. The valve body 25 selectively opens and closes the communication passage 2*b* and comprises a valve main body 28 and a retaining member 29. The valve main body 28 has a tapered peripheral surface which decreases in diameter toward one end (right end as viewed in FIG. 2), and has the other end face formed integrally with a central projection 30. The projection 30 is force fitted in the retaining member 29 to combine the valve main body 28 and the retaining member 29 together, thus forming the valve body 25.

When the suction pressure Ps is higher than a predetermined value (Ps > the force of the first spring 27), the bellows 24 contracts to allow the valve body 25 to open, and when the suction pressure Ps is lower than the predetermined value (Ps < the force of the spring 27), the bellows 24 expands to allow the valve body 25 to close. The retaining member 29 comprises a hollow cylinder 31 which has opposite open ends and is formed integrally with an annular radial flange 32 at one end thereof (right end as viewed in FIG. 2). The valve body 25 is axially slidably disposed in one end portion of the casing 18. One end of the valve main body 28 extends into the communication passage 2*b* of the cylinder block 2 through the valve hole 18*c* in the casing 18 and the hole 19*a* in the seat member 19 for axial movement to open and close the communication passage 2*b*. The first movable member 26 comprises a hollow cylinder which is open at one end (left end as viewed in FIG. 2) and closed at the other end and is formed integrally with an annular radial flange 34. The first movable member 26 is axially slidably disposed within the casing 18 in spaced opposite relation to the valve body 25. The bellows 24 is interposed between the opposed faces of the flange 32 of the valve body 25 and the flange 34 of the first movable member 26. Both ends of the bellows 24 are mounted on radially outer portions of the flanges 32 and 34 in airtight manner, respectively. The first spring 27 is in the form of a coil with one end thereof freely fitted on the hollow cylinder 31 of the valve body 25 and the other end thereof on the hollow cylinder 33 of the first movable member 26, respectively. Both ends of the first spring 27 are in urging contact with radially inner faces of the flanges 32 and 34, whereby the valve body 25 and the first movable member 26 are urged in directions away from each other. An annular partitioning wall 35 is fixed to an inner peripheral surface of the casing 18 at an axially intermediate location thereof and divides the casing 18 into two parts. The partitioning wall 35 determines the left extreme position of the first movable member 26 as viewed in FIG. 2. Further, the fixed position of the partitioning wall 35 decides the valve-opening pressure of the valve body 25. A hermetically closed space is defined by the bellows 24, the valve body 25 and the first movable member 26 and is vacuous in which is charged oil (not shown) in a volume of 70% to 80% of the whole volume of the space. The viscosity of the oil in the corrugated peripheral wall of the bellows 24 gives a "damping effect" to the bellows 24 as it expands or contracts upon rapid opening or closing of the valve body 25.

The high pressure-operated portion 23 comprises a second movable member 37, a movable spring seat 38, and a second spring 39 which urges the second movable member 37 toward the first movable member 26. The second movable member 37 comprises an urging member 40 and a pressure-receiving member 41. The urging member 40 is in the form of a hollow cylinder with opposite open ends. The urging member 40 is axially movable so that one end (right end as viewed in FIG. 2) of the member 40 is brought into or out of contact with the first movable member 26 through a central hole 35*a* in the partitioning wall 35 through which the member 40 is airtightly fitted. The pressure-receiving member 41 is in the form of an annular plate formed centrally with a fitting hole 43, and is disposed to receive discharge pressure Pd at one end face (right end face as viewed in FIG. 2) and suction pressure Ps at the other end face (left end face as viewed in FIG. 2), respectively. An end portion of the urging member 40 is rigidly fitted in the fitting hole 43 whereby the urging member 40 and the pressure-receiving member are integrated with each other to form the second movable member 37. The movable spring seat 38 is in the form of a disc and is axially slidably disposed inside the casing 18 on the rear head side thereof in spaced and opposite relation to the second movable member 37. The second spring 39 is in the form of a coil, with one end thereof in urging contact with a radially outer portion of the pressure-receiving member 41 of the second movable member 37, and the other end thereof with with a radially outer portion of the movable spring seat 38, respectively. Accordingly, the second movable member 37 and the movable spring seat 38 are urged in directions away from each other by the second spring 39. Rigidly fitted in the casing 18 on the rear head side of the partitioning wall 35 is a cylindrical member 44 of which one end face (right end face as viewed in FIG. 2) is open and the other end face (left end face as viewed in FIG. 2) is closed. The one end face of the cylindrical member 44 is in contact with the partitioning wall 35, and the other end face forms a closed wall 45 through which is threadedly fitted an adjusting screw 46, which has an inner end face disposed in urging contact with a diametric center of the movable spring seat 38, to determine the left extreme position of the movable spring seat 38 as viewed in FIG. 2 (remote from the valve body). The setting load of the second spring 39 can be adjusted by the adjusting screw 46. The pressure-receiving member 41 of the second movable member 37 is slidably fitted in the cylindrical member 44 in airtight manner. The interior of the cylindrical member 44 communicates with the interior of the right-half portion of the casing 18 via a central hole 40*a* of the pressing member 40, whereby suction pressure Ps acts upon the other end surface of the pressure-receiving member. Further, a notch 40*b* is formed in one end face of the flange 34 of the first movable member 26, whereby even when the urging member 40 is in contact with the first movable member 26, communication is maintained between the central hole 40*a* and the interior of the right-half portion of the casing 18. The interior of the cylindrical member 44 communicates with the second discharge pressure chamber $10_2$ of the discharge pressure chamber 10 via an axial hole 47 formed through the peripheral wall of the cylindrical member 44 and the communication passage 21 in the rear head 4.

The casing 18 is urged by a wave-shaped spring 17*a* toward the right side as viewed in FIG. 2 (toward the seat member 19), whereby airtightness is maintained between the seat member 19 and the cylinder block 2 at a contacting portion 2*c*, and between the seat member 19 and the casing 18 at a contacting portion 18*d*, respectively, to prevent the refrigerant from leaking from the crankcase pressure Pw-prevailing side into the suction pressure Ps-prevailing side through the contacting portions 2*c*, 18*d*.

The drive shaft 7 has an end portion toward the rear head 4 rotatably fitted in a central hole 48 in the cylinder block 2 via a bearing 49, while the other end portion toward the front head 5 is rotatably fitted in a central hole 50 in the front head 5 via a radial bearing 51. The end portion of the drive shaft 7 toward the front head 5 further extends through a projected portion of the front head 5 to the outside as an exterior extension with which a clutch, not shown, and a pulley, not shown, are connected. The pulley is connected, by a drive belt, not shown, with a pulley on an output shaft of an engine, not shown, which is installed on the vehicle, so that the rotation of the engine is transmitted to the drive shaft 7.

A rotary retainer 53 is fitted around the drive shaft 7 at a location adjacent the front head 5 for transmitting the rotation of the drive shaft 7 to a wobble plate support member 52. The rotary retainer 53 is rotatably axially supported by the front head 5 via a thrust bearing 54. The rotary retainer 53 is connected with a wobble plate support member 52 by means of a link arm 55 pivotally joined to the both members 52 and 53. To be specific, the link arm 55 has one end pivoted by means of a pin 56 to a peripheral lower portion of the rotary retainer 53 and the other end by means of a pin 57 to a peripheral lower portion of the wobble plate support member 52.

The wobble plate support member 52 has a central through hole 52*a* formed therein, in which the drive shaft 7 is freely fitted. A hinge ball 58, which is axially slidably fitted on an axially middle portion of the drive shaft 7, is slidably fitted in the central through hole 52*a* of the support member 52. Fitted on a portion of the drive shaft 7 between the hinge ball 58 and the rotary retainer 53 is a wave-shaped spring 59 urging the hinge ball 58 leftward as viewed in FIG. 1, i.e. toward the cylinder block 2. A stopper 60 is rigidly secured on an end of the drive shaft 7 toward the cylinder block 2. A plurality of leaf springs 61 and a coiled spring 62 are interposed around the drive shaft 7 between the stopper 60 and the hinge ball 58 and arranged in the mentioned order, urging the hinge ball 58 toward the front head 5 or rightward as viewed in FIG. 1.

A wobble plate 66 is mounted on the wobble plate support member 52 via a radial bearing 63 and thrust bearings 64 and 65 for rotation relative to the support member 52, the thrust bearings 64, 65 being secured to the wobble plate support member 52 by means of a bearing retaining plate 67. Each of the pistons 9 is pivotally joined to a peripheral edge portion of the wobble plate 66 by means of a piston rod 68 having opposite end balls 68*a*, 68*b* pivotally fitted in associated ends of the piston and the peripheral edge portion of the wobble plate 66. Thus, as the drive shaft 7 rotates to cause rotation of the rotary retainer 53 and the wobble plate support member 52, the wobble plate 66 is axially swung about the hinge ball 58, to cause the pistons 9 to make reciprocating motions within their respective cylinders 8 via the respective piston rods 68 whereby refrigerant gas is sucked and compressed.

A restraint pin 69 is inserted into an outer peripheral surface of the wobble plate 41 in a manner inwardly extending to a location close to the axis of the wobble plate. A plate-like slipper 70 is rotatably fitted on a radially outer end portion of the restraint pin 69.

A pair of parallel guide plates 71, only one of which is shown, are affixed to an inner peripheral surface of the housing 1 facing the slipper 70 and extend from the end face of the cylinder block 2 facing toward the front head 5 to an opposed inner surface of the front head 5 in a direction parallel to the axis of the drive shaft 7. Thus, the restraint pin 69 and slipper 70 are moved along a channel defined between the guide plates 71 together with swinging motion of the wobble plate 66. That is, the wobble plate 66 is prohibited from making circumferential movement relative to the drive shaft 7 but is allowed to make axially swinging motion about the hinge ball 58 in directions parallel with the axis of the drive shaft 7. The hinge ball 58 is moved along the axis of the drive shaft 7 by the linking action of the link arm 55 in accordance with a change in the inclination angle of the wobble plate 66, to assume a position corresponding to the inclination angle of the wobble plate 66, that is, the hinge ball 58 is positioned farther from the pistons 9 with an increase in the inclination angle of the wobble plate.

The operation of the variable capacity wobble plate compressor of the first embodiment of the invention constructed as above will be described below.

When the rotational power of the automobile engine, not shown, is transmitted to the drive shaft 7, via the drive belt, pulley, clutch, etc., none of them being shown, the drive shaft 7 rotates together with the rotatory retainer 53 and the wobble plate support member 52. With the rotation of the drive shaft 7, the wobble plate 66 is swung about the hinge ball 58 in the directions parallel to the axis of the drive shaft 7. The inclination angle of the wobble plate varies with a change in the pressure Pw in the crankcase 6, whereby, the stroke length of the pistons 9 is varied to cause a change in the delivery quantity or capacity. To be specific, with a decrease in the pressure Pw in the crankcase, the inclination angle of the wobble plate increases, accompanied by an increase in the stroke length of the pistons 9 to increase the delivery quantity or capacity. On the other hand, with an increase in the pressure Pw in the crancкase, the inclination angle of the wobble plate 66 decreases, accompanied by a decrease in the stroke length of the pistons 9 to decrease the delivery quantity or capacity.

During operation of the compressor, discharge pressure Pd in the second discharge pressure chamber $10_2$ of the discharge pressure chamber 10 acts upon one end face of the pressure-receiving member 41 of the second movable member 37 via the communication passage 21 in the rear head 4 and the hole 47 in the cylindrical member 44. On the other hand, suction pressure Ps in the suction chamber 15 acts upon the other end face of the pressure-receiving member 41 via the hole 3*d* in the valve plate 3, portion 16*a* of the valve chamber 16 located in the cylinder block 2, the holes 18*b* in the tapered surface 18*a* of the casing 18, the interior of the right-half portion of the casing 18, the notch 40*b* in the urging member 40, and the central hole 40*a*.

When the compressor is in a heavy load state (wherein the discharge pressure Pd and suction pressure Ps are higher than respective predetermined values), the discharge pressure Pd acting upon the one end face of the pressure receiving member 41 is greater than the sum of the suction pressure Ps in the suction chamber 15 and the force of the second spring 39 (Pd>Ps+the force of the second spring 39), so that the second movable member 37 is urgedly biased leftward as viewed in FIG. 2 (away from the first movable member 26) against the sum of the force of the second spring 39 and the suction pressure Ps, whereby the urging member 40 of the second movable member 37 is separated from the first movable member 26. Further, the suction pressure Ps in the suction chamber 15 acts upon the bellows 24 via the hole 3*d* in the valve plate 3, the portion 16*a* of the valve chamber 16 located in the cylinder block 2, and the holes 18*b* in the tapered surface 18*a* of the casing 18, whereby the valve body 25 is urgedly biased leftward as viewed in FIG. 2 (toward the second movable member 7), i.e., in the opening direction against the urging force of the first spring 27, so that the valve body 25 fully opens the communication passage 2*b* in the cylinder block. In this state, the pressure Pw in the crankcase 6 flows into the suction chamber 15 at the maximum flow rate via the communication passage 2*b* in the cylinder block 2, the hole 19*a* in the seat member 19, the valve hole 18*c* in the casing 18, the holes 18*b* in the tapered surface 18*a*, the portion 16*a* of the valve chamber 16 located in the cylinder block 2, and the hole 3*d* of the valve plate 3 in the mentioned order, whereby the pressure Pw in the crankcase 6 greatly decreases. Accordingly, the wobble plate 66 assumes the maximum inclination angle and the pistons 9 have the maximum stroke length, resulting in the maximum delivery quantity or capacity.

Next, when the compressor is in a medium load state (wherein the discharge pressure Pd and suction pressure Ps are substantially equal to the respective predetermined values), the discharge pressure Pd overcomes the sum of the urging force of the second spring 39 and the suction pressure Ps, so that the second movable member 37 is urgedly biased leftward as viewed in FIG. 2 (away from the first movable member 26), not exerting any urging force upon the first movable member 26. On this occasion, the valve body 25 is urgedly biased by the first spring 27 against the suction pressure Ps in the closing direction, whereby the valve body 25 restricts the communication passage 2*b* to a medium opening.

Accordingly, a restricted amount of pressure Pw flows from the crankcase 6 into the suction chamber 15, whereby the pressure Pw in the crankcase increases. The increased pressure Pw in the crankcase causes the wobble plate 66 to assume a medium inclination angle intermediate between the maximum inclination angle and the minimum one, whereby the pistons 9 have a medium stroke length, resulting in a medium delivery quantity or capacity.

When the compressor is in a low load state (wherein the discharge pressure Pd and suction pressure Ps are lower than the respective predetermined values), the valve body 25 is urged by the force of the first spring 27 in the closing direction against suction pressure Ps. Further, by an urging force of the sum of the force of the second spring 39 and the suction pressure Ps, the second movable member 37 is urgedly biased against the discharge pressure Pd rightward as viewed in FIG. 2 (toward the first movable member 26), whereby the urging member 40 urges the whole low pressure-operated portion 22, that is, the bellows 24, the valve body 25, the first movable member 26 and the first spring 27, in the valve-closing direction so that the valve body 25 further restricts the degree of opening of the communication passage 2*b* to a smaller value. This causes a further decrease in the amount of pressure Pw in the crankcase 6 which flows through the communication passage 2*b* into the suction chamber 15, whereby the pressure Pw in the crankcase is futher elevated, accompanied by a decrease in the inclination angle of the wobble plate 66. This, in turn, causes the stroke length of the pistons 9 to decrease, resulting in a reduced delivery quantity or capacity.

Figure 4:
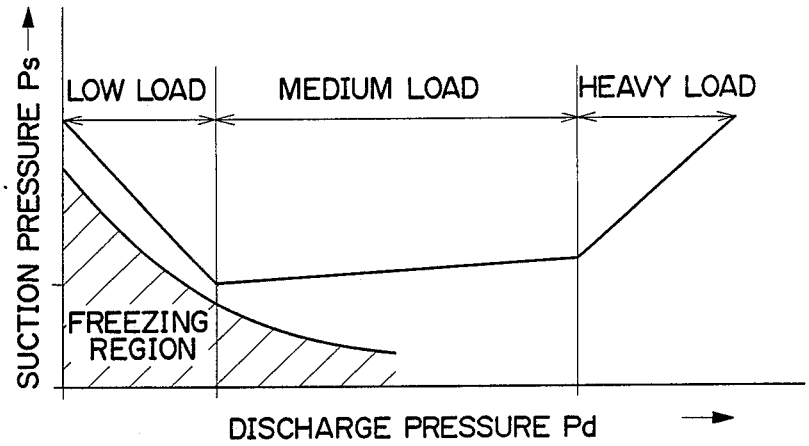
FIG. 4 is a graph illustrating a pressure-control characteristic of the pressure-control valve of the compressor of the present invention.

Provided with the pressure control valve 17 operating as described above, the compressor of the invention has a control characteristic as shown in FIG. 4. In FIG. 4, the ordinate represents suction pressure Ps, and the abscissa discharge pressure Pd (instead of dicharge pressure Pd, a parameter indicative of a thermal load, such as ambient temperature, may be employed), respectively. The hatched part indicates a region in which the evaporator is brought into a frozen state. As is learned from the FIG. 4 graph, as the discharge pressure Pd decreases, the valve body 25 is displaced in the closing direction by the urging force consisting of the force of the second spring 39 and the suction pressure Ps to more positively close the communication passage 2*b*, whereby the delivery quantity or capacity is decreased. The decreased delivery quantity or capacity results in a decrease in the amount of refrigerant flowing into the evaporator. Accordingly, the outlet pressure of the evaporator is elevated to cause the outlet temperature of the evaporator to be elevated, which prevents the evaporator from being frozen. Further, the amount of the pressure Pw which flows from the crankcase into the suction chamber 15 is reduced to thereby prevent power loss or energy loss of the compressor.

Although, in the embodiment described above, the interior of the bellows 24 is vacuous, and is charged with oil to obtain the dampering effect, it is not limitative, but the interior of the bellows may be open to the atmosphere or may be filled with an inert gas.

Figure 3:
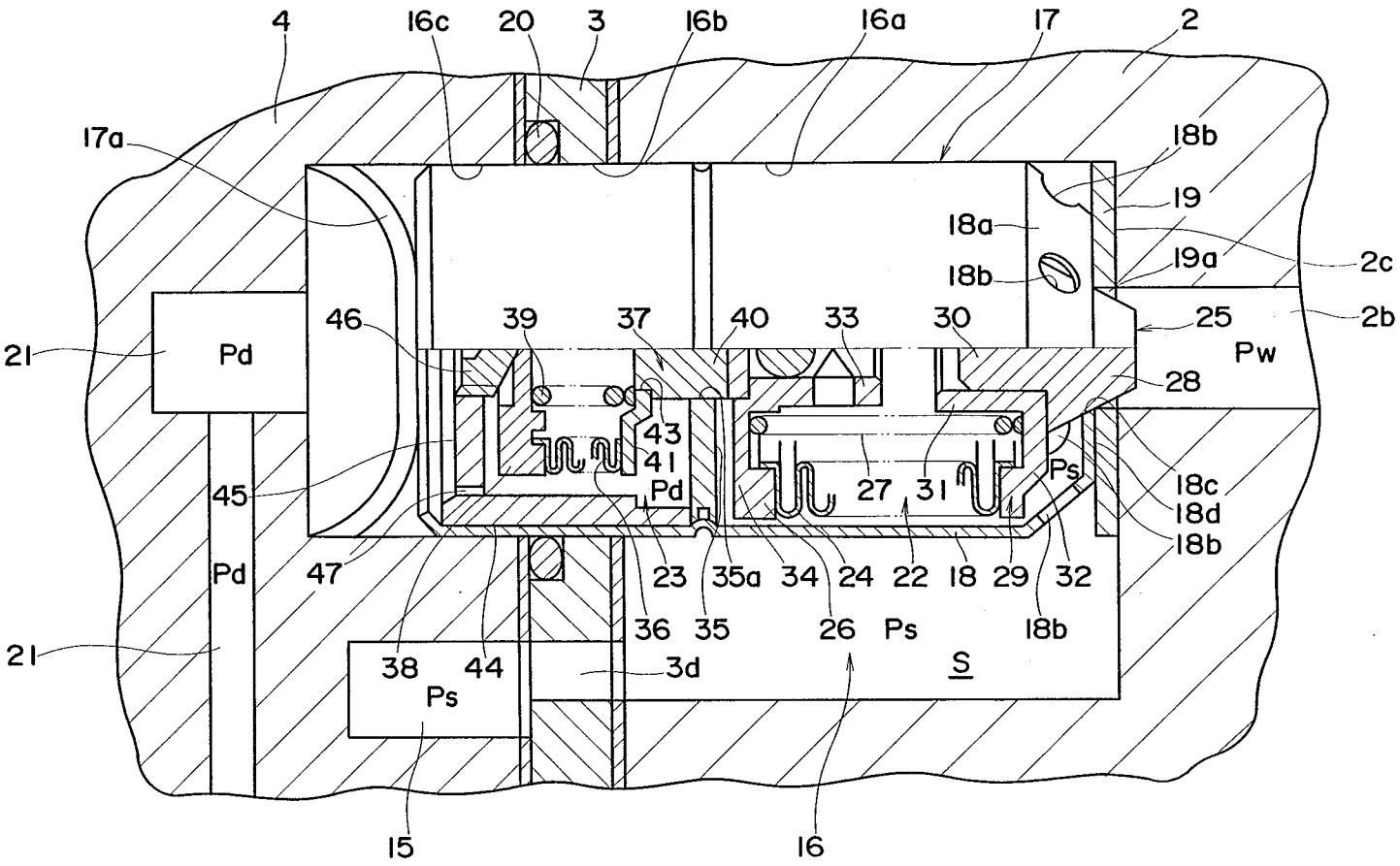
FIG. 3 is another enlarged fragmentary view of the portion A of FIG. 1 which illustrates a pressure-control valve of a second embodiment of the present invention.

FIG. 3 shows a second embodiment of the invention, which is different from the first embodiment only in the construction of the high pressure-operated portion of the pressure-control valve 17. Therefore, only the high pressure-operated portion will be described below with reference to FIG. 3, and description of the other parts or elements is omitted, which are identical in structure and function with their respective counterparts of the first embodiment. In FIG. 3, the elements and parts corresponding to those shown in FIG. 2, are designated by the same reference numerals.

In FIG. 3, the high pressure-operated portion 23 comprises a second bellows 36, a second movable member 37 attached to one end (right end as viewed in FIG. 3) of the second bellows 36, a movable spring seat 38 attached to the other end of the second bellows 36, and a secod spring 39 which is disposed within the second bellows 36 and urges the second movable member 37 toward the first movable member 26. The second bellows 36 is in the form of a cylinder having opposite open ends and a corrugated peripheral surface and is axially expandable and contractible depending on the discharge pressure Pd. The second movable member 37 comprises an urging member 40 and a pressure-receiving member 41. The urging member 40 is in the form of a cylinder having a solid interior. The urging member 40 is axially movable so that one end (right end as viewed in FIG. 3) of the member 40 is brought into or out of contact with the first movable member 26 through a central hole 35*a* in the partitioning wall 35 through which the member 40 is airtightly fitted. The pressure-receiving member 41 is in the form of an annular plate formed centrally with a fitting hole 43, and is disposed to receive discharge pressure Pd at one end face (right end face as viewed in FIG. 3) An end portion of the urging member 40 is rigidly fitted in the fitting hole 43 whereby the urging member 40 and the pressure-receiving member 41 are integrated with each other to form the second movable member 37. The movable spring seat 38 is in the form of a disc and is axially slidably disposed inside the casing 18 on the rear head side thereof in spaced and opposite relation to the second movable member 37. Interposed between the second movable member 37 and the movable spring seat 38 is the second bellows 36, both ends of which are affixed in an airtight manner to the pressure-receiving member 41 and the movable spring seat 38 at respective radially outer portions thereof. The second spring 39 is in the form of a coil, with one end thereof in urging contact with a radially inner portion of the pressure-receiving member 41 of the second movable member 37, and the other end thereof with a radially inner portion of the movable spring seat 38, respectively. Accordingly, the second movable member 37 and the movable spring seat 38 are urged in directions away from each other by the second spring 39. Rigidly fitted in the casing 18 on the rear head side of the partitioning wall 35 is a cylindrical member 44 of which one end face (right end face as viewed in FIG. 3) is open and the other end face (left end face as viewed in FIG. 3) is closed. The one end face of the cylindrical member 44 is in contact with the partitioning wall 35, and the other end face forms a closed wall 45 through which is threadedly fitted an adjusting screw 46, which has an inner end face disposed in urging contact with a diametric center of the movable spring seat 38, to determine the left extreme position of the movable spring seat 38 as viewed in FIG. 3 (remote from the valve body). The setting load of the second spring 39 can be adjusted by the adjusting screw 46. The space defined in the cylindrical member 44 by the second bellows 36, the second movable member 37, the movable spring seat 38, the cylindrical member 44, and the partitioning wall 35 communicates with the second discharge pressure chamber $10_2$ of the discharge pressure chamber 10 via an axial hole 47 formed in a peripheral portion of the closed wall 45 of the cylindrical member 44, and the communication passage 21 in the rear head 4.

The operation of the variable capacity wobble plate compressor of the second embodiment of the present invention constructed as above will be described below.

When the compressor is in a heavy load state (wherein the discharge pressure Pd and suction pressure Ps are higher than respective predetermined values), the discharge pressure Pd acting upon the one end face of the pressure-receiving member 41 of the second movable member 37 via the communication passage 21 in ther rear head 4 and the hole 47 in the closed wall 45 is greater than the force of the second spring 39 (Pd > the force of the second spring 39), so that the second movable member 37 is urgedly biased leftward as viewed in FIG. 3 (away from the first movable member 26) against the force of the second spring 39, whereby the urging member 40 of the second movable member 37 is separated from the first movable member 26. Further, the suction pressure Ps in the suction chamber 15 acts upon the bellows 24 via the hole 3*d* in the valve plate 3, the portion 16*a* of the valve chamber 16 located in the cylinder block 2, and the holes 18*b* in the tapered surface 18*a* of the casing 18, whereby the valve body 25 is urgedly biased leftward as viewed in FIG. 3 (toward the second movable member 37), i.e., in the opening direction against the urging force of the first spring 27, so that the valve body 25 fully opens the communication passage 2*b* in the cylinder block. In this state, the pressure Pw in the crankcase 6 flows into the suction chamber 15 at the maximum flow rate via the communication passage 2*b* in the cylinder block 2, the hole 19*a* in the seat member 19, the valve hole 18*c* in the casing 18, the holes 18*b* in the tapered surface 18*a*, the portion 16*a* of the valve chamber 16 located in the cylinder block 2, and the hole 3*d* of the valve plate 3 in the mentioned order, whereby the pressure Pw in the crankcase 6 greatly decreases. Accordingly, the wobble plate 66 assumes the maximum inclination angle and the pistons 9 have the maximum stroke length, resulting in the maximum delivery quantity or capacity.

Next, when the compressor is in a medium load state (wherein the discharge pressure Pd and suction pressure Ps are substantially equal to the respective predetermined values), the discharge pressure Pd overcomes the urging force of the second spring 39, so that the second movable member 37 is urgedly biased leftward as viewed in FIG. 3 (away from the first movable member 26), not exerting any urging force upon the first movable member 26. On this occasion, the valve body 25 is urgedly biased by the first spring 27 against the suction pressure Ps in the closing direction, whereby the valve body 25 restricts the communication passage 2b to a medium opening.

Accordingly, a restricted amount of pressure Pw flows from the crankcase 6 into the suction chamber 15, whereby the pressure Pw in the crankcase increases. The increased pressure Pw in the crankcase causes the wobble plate 66 to assume a medium inclination angle intermediate between the maximum inclination angle and the minimum one, whereby the pistons 9 have a medium stroke length, resulting in a medium delivery quantity or capacity.

When the compressor is in a low load state (wherein the discharge pressure Pd and suction pressure Ps are lower than the respective predetermined values), the valve body 25 is urged by the force of the first spring 27 in the closing direction against suction pressure Ps. Further, by the force of the second spring 39, the second movable member 37 is urgedly biased against the discharge pressure Pd rightward as viewed in FIG. 3 (toward the first movable member 26), whereby the urging member 40 urges the whole low pressure-operated portion 22, that is, the first bellows 24, the valve body 25, the first movable member 26 and the first spring 27, in the valve-closing direction so that valve body 25 further restricts the degree of opening of the communication passage 2b to a smaller value. This causes a further decrease in the amount of pressure Pw in the crankcase 6 which flows through the communication passage 2b into the suction chamber 15, whereby the pressure Pw in the crankcase is futher elevated, accompanied by a decrease in the inclination angle of the wobble plate 66. This, in turn, causes the stroke length of the pistons 9 to decrease, resulting in a reduced delivery quantity or capacity.

Provided with the pressure control valve 17 operating as described above, the compressor of the invention has a control characteristic as shown in FIG. 4. According to the construction of the second embodiment, like the first embodiment, as the discharge pressure Pd decreases, the valve body 25 is displaced in the closing direction by the urging force of the second spring 39 to more positively close the communication passage 2b, whereby the delivery quantity or capacity is decreased. As a result, the freezing of the evaporator and the power loss as well can be prevented without fail.

Instead of the bellows 24 used in the first and second embodiments and the bellows 36 used in the second embodiment, other types of deformable means, such as a diaphragm which is displaceable according to the suction pressure Ps and discharge pressure Pd may be used.

What is claimed is:

1. A variable capacity wobble plate compressor comprising: a crankcase; a wobble plate accomodated within said crankcase; a suction chamber; a discharge pressure chamber; a communication passage communicating between said crankcase and said suction chamber; and a pressure-control valve disposed across said communication passage for adjusting pressure in said crankcase to change the inclination angle of said wobble plate whereby the delivery quantity or capacity is varied, said pressure-control valve comprising deformable means variable in length with a change in the suction pressure; a valve body attached to one end of said deformable means for selectively opening and closing said communication passage depending on the length of said deformable means; a first movable member attached to the other end of said deformable means; a first spring interposed between said valve body and said first movable member and urging said valve body in a closing direction; a second movable member having a pressure-receiving portion for receiving at least discharge pressure from said discharge pressure chamber, said second movable member being selectively brought into and out of urging contact with said first movable member in response to at least a change in the discharge pressure acting upon said pressure-receiving portion; and a spring seat disposed in opposite and spaced relation to said pressure-receiving portion of said second movable member; and a second spring interposed between said spring seat and said second movable member, wherein when the discharge pressure is higher than a predetermined value, said second movable member is biased away from said first movable member by the discharge pressure against at least the force of said second spring, and when the discharge pressure is lower than the predetermined value, said second movable member is urged against said first movable member by at least the force of said second spring against the discharge pressure to urge said valve body in the closing direction via said first movable member, said first spring, and said deformable means.

2. A variable capacity wobble plate compressor as claimed in claim 1, in which said pressure-receiving portion of said second movable member receives at one side surface thereof the discharge pressure and at another side surface thereof the suction pressure, wherein when the discharge pressure is higher than a predetermined value, said second movable member is biased away from said first movable member by the force of the discharge pressure against the sum of the force of said second spring and said suction pressure, and when the discharge pressure is lower than the predetermined value, said second movable member is urged against said first movable member by the sum of the force of said second spring and the suction pressure against the discharge pressure to urge said valve body in the closing direction via said first movable member, said first spring, and said deformable means.

3. A variable capacity wobble plate compressor as claimed in claim 1 in which there is provided second deformable means variable in length with a change in the discharge pressure, said second movable member being attached to one end of said second deformable means, said spring seat being attached to the other end of said second deformable means, wherein when the discharge pressure is lower than a predetermined value, said second movable member is urged against said first movable member by the force of said second spring against the force of the discharge pressure to urge said valve body in the closing direction via said first movable member, said first spring, and said first-mentioned deformable means.

* * * * *